US010018053B2

(12) United States Patent
Taniguchi et al.

(10) Patent No.: US 10,018,053 B2
(45) Date of Patent: Jul. 10, 2018

(54) TURBINE BLADE COOLING STRUCTURE

(71) Applicants: KAWASAKI JUKOGYO KABUSHIKI KAISHA, Kobe-shi, Hyogo (JP); B&B AGEMA GmbH, Aachen (DE)

(72) Inventors: Tomoki Taniguchi, Kobe (JP); Ryozo Tanaka, Kakogawa (JP); Takeshi Horiuchi, Kobe (JP); Takao Sugimoto, Kobe (JP); Masahide Kazari, Akashi (JP); Karsten Kusterer, Moresnet (BE); Dieter Bohn, Moers (DE); Gang Lin, Aachen (DE)

(73) Assignees: KAWASAKI JUKOGYO KABUSHIKI KAISHA, Kobe-shi (JP); B&B AGEMA GmbH, Aachen (DE)

( * ) Notice: Subject to any disclaimer, the term of this patent is extended or adjusted under 35 U.S.C. 154(b) by 204 days.

(21) Appl. No.: 14/944,441

(22) Filed: Nov. 18, 2015

(65) Prior Publication Data

US 2016/0115796 A1 Apr. 28, 2016

Related U.S. Application Data

(63) Continuation of application No. PCT/JP2014/062992, filed on May 15, 2014.

(30) Foreign Application Priority Data

May 20, 2013 (JP) ..... 2013-105818

(51) Int. Cl.
*F01D 5/18* (2006.01)

(52) U.S. Cl.
CPC ..... *F01D 5/187* (2013.01); *F05D 2240/303* (2013.01); *F05D 2250/141* (2013.01);
(Continued)

(58) Field of Classification Search
CPC ..... F01D 5/187; F05D 2240/303; F05D 2250/141; F05D 2250/15; F05D 2250/231;
(Continued)

(56) References Cited

U.S. PATENT DOCUMENTS 3,781,129 A * 12/1973 Aspinwall ..... F01D 5/189 415/115
4,505,639 A * 3/1985 Groess ..... F01D 5/187 415/115
(Continued)

FOREIGN PATENT DOCUMENTS

CN 102414398 A 4/2012
EP 0971095 A2 1/2000
(Continued)

OTHER PUBLICATIONS

Japanese Notification of Reason(s) for Rejection issued in JP 2013-105818 dated Feb. 25, 2014.
(Continued)

*Primary Examiner* — Kenneth Bomberg
*Assistant Examiner* — Brian Delrue
(74) *Attorney, Agent, or Firm* — Sughrue Mion, PLLC

(57) ABSTRACT

In a structure for internally cooling a turbine blade, a cooling medium passage is provided in the turbine blade. The cooling medium passage has a shape in which a plurality of cylindrical spaces, each having substantially cylindrical shape, extending in parallel with each other partially overlap each other. A cooling medium supply passage that supplies a cooling medium to the cooling medium passage is connected to a portion of the cooling medium passage that includes a peripheral wall, in a direction that forms an acute angle with respect to a longitudinal direction of the cooling medium passage.

5 Claims, 6 Drawing Sheets

(52) U.S. Cl.
CPC .... *F05D 2250/15* (2013.01); *F05D 2250/231* (2013.01); *F05D 2250/25* (2013.01); *F05D 2250/312* (2013.01); *F05D 2250/314* (2013.01); *F05D 2250/72* (2013.01); *F05D 2260/201* (2013.01); *F05D 2260/2212* (2013.01); *F05D 2260/2214* (2013.01)

(58) Field of Classification Search
CPC ..... F05D 2250/25; F05D 2250/312; F05D 2250/314; F05D 2250/72; F05D 2260/201; F05D 2260/2212; F05D 2260/2214
USPC ..... 416/97 R
See application file for complete search history.

(56) References Cited

U.S. PATENT DOCUMENTS

| | | | | |
|---|---|---|---|---|
| 4,786,233 | A * | 11/1988 | Shizuya | F01D 5/187 416/90 R |
| 5,002,460 | A * | 3/1991 | Lee | F01D 5/188 415/115 |
| 5,603,606 | A * | 2/1997 | Glezer | F01D 5/187 415/115 |
| 5,704,763 | A * | 1/1998 | Lee | F01D 5/188 415/115 |
| 6,099,251 | A | 8/2000 | LaFleur | |
| 6,431,832 | B1 * | 8/2002 | Glezer | F01D 5/187 416/97 R |
| 6,808,367 | B1 * | 10/2004 | Liang | F01D 5/187 415/115 |
| 7,137,781 | B2 * | 11/2006 | Harvey | F01D 5/187 415/115 |
| 7,513,739 | B2 * | 4/2009 | Boury | F01D 5/187 415/115 |
| 7,661,930 | B2 * | 2/2010 | Deschamps | F01D 5/187 416/97 R |
| 7,780,414 | B1 * | 8/2010 | Liang | B22C 9/10 164/369 |
| 7,862,299 | B1 * | 1/2011 | Liang | F01D 5/147 416/97 R |
| 8,128,366 | B2 * | 3/2012 | Strock | F01D 5/186 416/97 R |
| 8,777,559 | B2 | 7/2014 | Koyabu et al. | |
| 9,051,841 | B2 | 6/2015 | Janke et al. | |
| 2005/0265840 | A1 * | 12/2005 | Levine | F01D 5/187 416/97 R |
| 2005/0265844 | A1 * | 12/2005 | Levine | F01D 5/187 416/97 R |
| 2009/0304499 | A1 | 12/2009 | Strock et al. | |
| 2011/0044805 | A1 | 2/2011 | Koyabu et al. | |
| 2012/0076665 | A1 | 3/2012 | Janke et al. | |
| 2013/0175015 | A1 * | 7/2013 | Tanaka | F01D 5/186 165/168 |
| 2016/0319674 | A1 * | 11/2016 | Gleiner | B22C 9/06 |

FOREIGN PATENT DOCUMENTS

| | | | |
|---|---|---|---|
| EP | 2131108 | A2 | 12/2009 |
| EP | 2434093 | A2 | 3/2012 |
| GB | 855777 | A | 12/1960 |
| JP | 2008-038774 | A | 2/2008 |
| JP | 2012-154232 | A | 8/2012 |

OTHER PUBLICATIONS

Japanese Decision of Grant issued in JP 2013-105818 dated Jun. 10, 2014.
International Search Report of PCT/JP2014/062992 dated Jun. 17, 2014.
Communication dated Feb. 9, 2017 from the European Patent Office in counterpart European application No. 14801881.5.
Communication dated Dec. 1, 2017, from State Intellectual Property Office of the P.R.C. in counterpart application No. 201480028931.0.
International Preliminary Report on Patentability dated Dec. 3, 2015 from the International Bureau in counterpart International Application No. PCT/JP2014/062992.
Communication dated May 4, 2016 from the State Intellectual Property Office of the P.R.C. issued in corresponding Application No. 201480028931.0.
Communication dated Nov. 28, 2016 from the Canadian Intellectual Property Office in counterpart application No. 2912823.
Communication dated Jun. 5, 2017 from the State Intellectual Property Office of the P.R.C. in counterpart application No. 201480028931.0.
Communication dated Nov. 28, 2016, from the State Intellectual Property Office of the P.R.C., in counterpart Chinese application No. 201480028931.0.

* cited by examiner

TURBINE BLADE COOLING STRUCTURE

CROSS REFERENCE TO THE RELATED APPLICATION

This application is a continuation application, under 35 U.S.C. § 111(a), of international application No. PCT/JP2014/062992, filed May 15, 2014, which claims priority to Japanese patent application No. 2013-105818, filed May 20, 2013, the disclosure of which are incorporated by reference in their entirety into this application.

BACKGROUND OF THE INVENTION

Field of the Invention

The present invention relates to a structure for internally cooling a turbine blade of a turbine of a gas turbine engine.

Description of Related Art

Since a turbine as a component of a gas turbine engine is disposed downstream of a combustor and is supplied with a high-temperature gas burned in the combustor, the turbine is exposed to high temperature while the gas turbine engine is driven. Therefore, turbine blades, i.e., a stator blade and a rotor blade of the turbine, need to be cooled. A structure has been known in which a portion of air compressed by a compressor is introduced into a cooling passage to cool the turbine blade. An example of such a cooling structure has been proposed in which a cooling passage is formed in a turbine blade by using a circular pipe, and air for cooling is supplied from an end of the cooling passage to cause a swirling flow (refer to Patent Document 1, for example).

RELATED DOCUMENT

Patent Document

[Patent Document 1] U.S. Pat. No. 5,603,606

SUMMARY OF THE INVENTION

When a portion of compressed air is used for cooling the turbine blade, a cooling medium need not be introduced from the outside, resulting in an advantage that the cooling structure can be simplified. On the other hand, when a large amount of air compressed by the compressor is used for cooling the turbine blade, efficiency of the engine is degraded. Therefore, such cooling needs to be efficiently performed with the minimum amount of air. However, in the structure of just flowing the air into the simple cylindrical space as described above, the air as a cooling medium just swirls in one direction in the cooling passage. In this case, temperature distribution in the cooling medium is non-uniform, and sufficient cooling effect cannot be achieved.

Therefore, an object of the present invention is to provide, in order to solve the above-described problem, a cooling structure capable of cooling a turbine blade with high efficiency by achieving uniform temperature distribution of a cooling medium that passes through a cooling passage in the turbine blade.

In order to achieve the above object, a turbine blade cooling structure according to the present invention is a structure for internally cooling a turbine blade including: a cooling medium passage provided in the turbine blade and having a shape in which a plurality of cylindrical spaces, each having a substantially cylindrical shape, extending in parallel with each other partially overlap each other; and a cooling medium supply passage to supply a cooling medium to the cooling medium passage connected to a portion of the cooling medium passage that includes a peripheral wall, in a direction that forms an acute angle with respect to a longitudinal direction of the cooling medium passage.

According to the above configuration, the cooling medium, which is supplied from the portion of the cooling medium passage that includes the peripheral wall to the cooling medium passage, separately flows into the plurality of cylindrical spaces, and forms swirling flows in the respective cylindrical spaces. Further, a portion of each swirling flow in one of the cylindrical spaces flows into the other cylindrical space through an overlapped region of the spaces. Thus, when the swirling flows of the cooling medium formed in the adjacent cylindrical spaces flow into the opposite cylindrical spaces, mixing of the cooling medium is promoted, and temperature distribution in the cooling medium is made uniform, resulting in high cooling efficiency. Furthermore, when each swirling flow in one cylindrical space flows into the other cylindrical space, the swirling flow collides against a partition edge formed between the cylindrical spaces, whereby high cooling effect due to impingement effect is achieved.

In one embodiment of the present invention, the two cylindrical spaces adjacent to each other may overlap each other such that an overlap length W along a straight line connecting centers of cross-sectional circles of the adjacent two cylindrical spaces satisfies a relationship of $0.05 \leq W/((D1+D2)/2) \leq 0.35$ with respect to a cross-sectional diameter D1 of one of the cylindrical spaces and a cross-sectional diameter D2 of the other cylindrical space. By setting the degree of overlapping of the cylindrical spaces in this way, it is possible to reliably cause a phenomenon in which separated swirling flows are generated in the respective cylindrical spaces, and each swirling flow in one cylindrical space flows into the other cylindrical space.

In one embodiment of the present invention, the cooling medium supply passage to supply the cooling medium to the cooling medium passage may be connected to the overlapped region of the adjacent two cylindrical spaces of the cooling medium passage. In this case, the cooling medium supply passage may be connected to the overlapped region such that the cooling medium supplied from the cooling medium supply passage collides against a partition edge formed between the adjacent two cylindrical spaces. In this configuration, since the cooling medium supplied from the cooling medium supply passage collides against the partition edge formed between the cylindrical spaces, the cooling medium is substantially uniformly distributed to the cylindrical spaces, whereby swirling flows in opposite directions, each having high directivity, are formed along the inner wall surfaces forming the cylindrical spaces. As a result, mixing of the cooling medium is further promoted. Further, also in the cooling medium supplying portion, the cooling medium may be caused to collide against the partition edge, whereby cooling of the wall surface is promoted due to the impingement effect. These effects result in extremely high cooling efficiency.

In one embodiment of the present invention, the cooling medium supply passage to supply the cooling medium to the cooling medium passage may be connected to a side portion of the cooling medium passage, located at a side opposite to the overlapped region of the cylindrical spaces, on the straight line connecting the centers of the cross-sectional circles of the adjacent two cylindrical spaces of the cooling medium passage. This configuration allows flexible design according to the shape of the portion of the turbine blade to which the cooling structure is applied.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Figure 1:
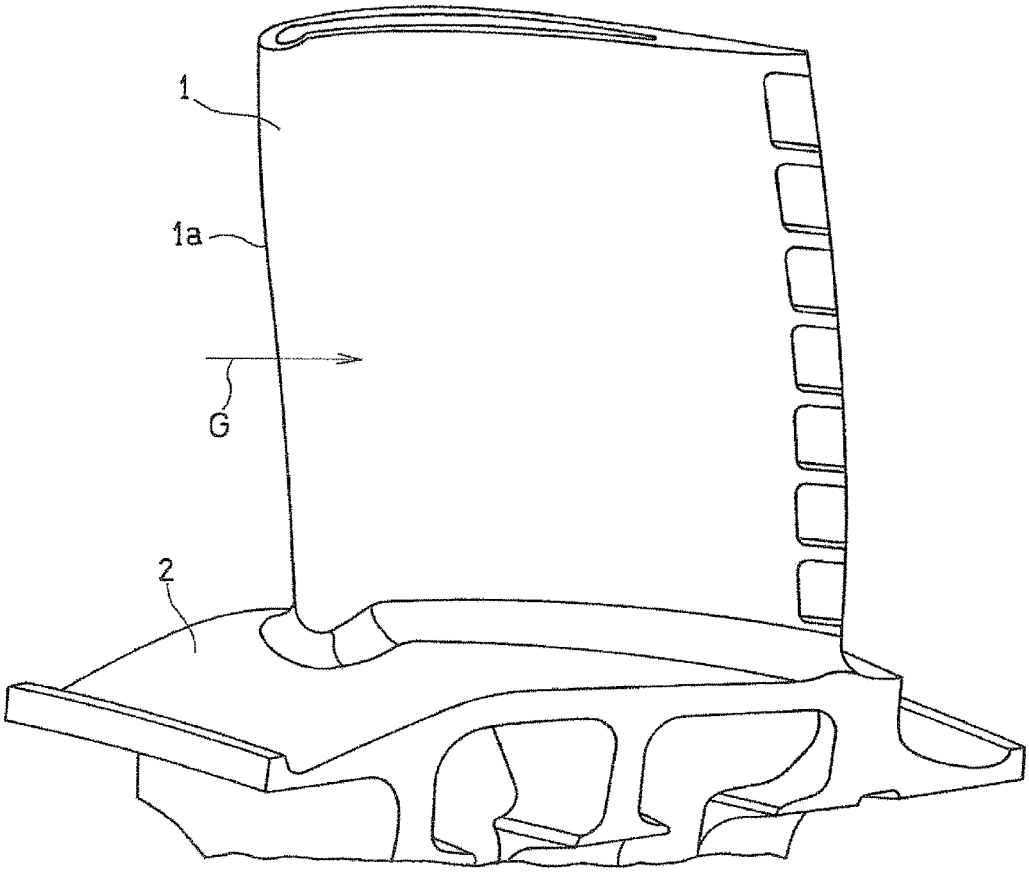
FIG. 1 is a perspective view showing an example of a turbine blade to which a cooling structure according to a first embodiment of the present invention is applied.

Hereinafter, embodiments of the present invention will be described with reference to the drawings. FIG. 1 is a perspective view showing a rotor blade 1 which is a turbine blade of a turbine of a gas turbine engine, to which a turbine blade cooling structure according to a first embodiment of the present invention is applied. Many turbine rotor blades 1 are implanted in a circumferential direction of a turbine disk, with platforms 2 thereof being connected to an outer peripheral portion of a turbine disk, thereby forming a turbine. Each turbine rotor blade 1 is exposed to a high-temperature gas G that is supplied from a combustor and flows in a direction indicated by the arrow. In the following description, an upstream side (left side in FIG. 1) along the flow direction of the high-temperature gas G is referred to as "front", and a downstream side (right side in FIG. 1) is referred to as "rear". In this embodiment, the cooling structure is applied to the inside of a front end portion 1*a* of the turbine rotor blade 1, where the temperature is particularly high.

Figure 2:
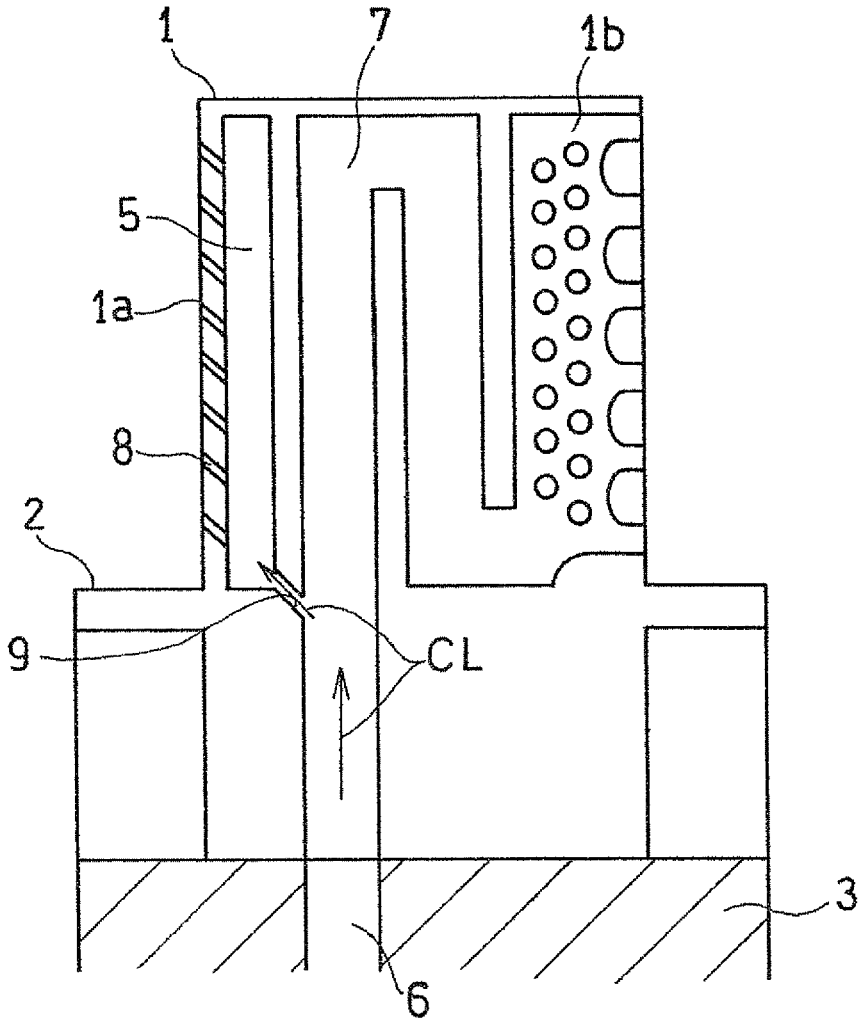
FIG. 2 is a cross-sectional view schematically showing the cooling structure of the turbine blade shown in FIG. 1.

As shown in FIG. 2, inside the front end portion 1*a* of the turbine rotor blade 1, a first cooling medium passage 5 extending along a radial direction of the turbine (up-down direction in FIG. 2) is formed. Compressed air from a compressor, which is used as a cooling medium CL, is introduced into the turbine rotor blade 1 through a cooling medium introduction passage 6 formed inside a turbine disk 3. A portion of the cooling medium CL introduced into the turbine rotor blade 1 is supplied to the first cooling medium passage 5. The remaining portion of the cooling medium CL introduced into the turbine rotor blade 1 is supplied to a second cooling medium passage 7 for cooling a rear portion 1*b* of the turbine rotor blade 1. The cooling medium CL passing through the cooling medium passages 5 and 7 internally cools the turbine rotor blade 1. The cooling medium CL supplied to the first cooling medium passage 5 is discharged from a discharge hole 8 communicating with the outside of the turbine rotor blade 1.

Figure 3:
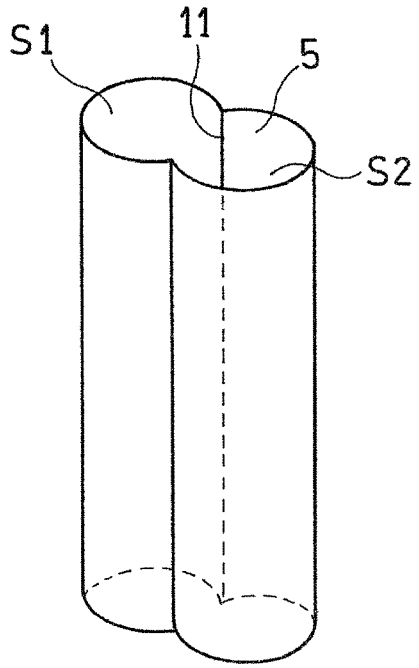
FIG. 3 is a perspective view showing the shape of a cooling medium passage of the cooling structure shown in FIG. 2.
Figure 4:
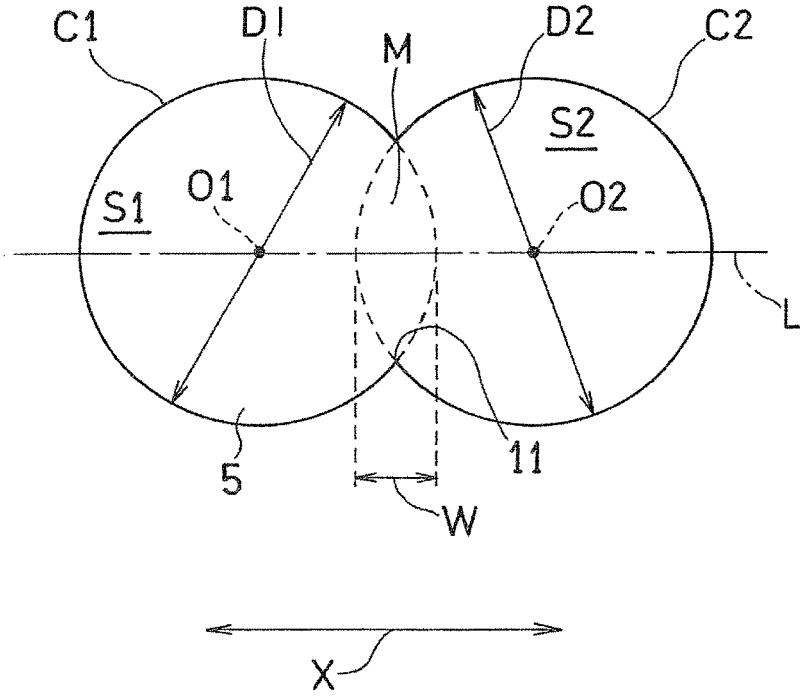
FIG. 4 is a cross-sectional view showing the shape of the cooling medium passage of the cooling structure shown in FIG. 2.

As shown in FIG. 3, the first cooling medium passage 5 has a shape in which a plurality of (two in this example) cylindrical spaces S1 and S2, each having a substantially cylindrical shape, extending in parallel with each other partially overlap each other. In other words, as shown in FIG. 4, the first cooling medium passage 5 has a cross-sectional shape in which two circles (hereinafter referred to as cross-sectional circles) C1 and C2 partially overlap each other. In this specification, the term "substantially cylindrical shape" is defined as a tubular shape having a circular cross-section, or a tubular shape having a cross-section which is an elliptical shape having a ratio of a minor axis length to a major axis length being 0.5 or more. In the illustrated example, a diameter D1 of one cross-sectional circle C1 and a diameter D2 of the other cross-sectional circle C2 are set to the same value, but these diameters D1 and D2 may be set to different values.

The degree of overlapping of the adjacent two cylindrical spaces S1 and S2 is not particularly limited as long as the cross-sectional circles C1 and C2 thereof are closer to each other than those circumscribed with each other, and are more apart from each other than those inscribed with each other (than the cross-sectional circles C1 and C2 completely overlapping each other, when the diameters D1 and D2 are equal to each other). However, a degree of overlapping for more effectively causing the cooling medium CL to be separated in the first cooling medium passage 5 is as follows. That is, an overlap length W along a straight line L connecting centers O1 and O2 of the cross-sectional circles C1 and C2 of the adjacent two cylindrical spaces S1 and S2 is preferably set to satisfy a relationship of $0.05 \leq W/((D1+D2)/2) \leq 0.35$ with respect to the diameter D1 of one cross-sectional circle C1 and the diameter D2 of the other cross-sectional circle C2. More preferably, a relationship of $0.10 \leq W/((D1+D2)/2) \leq 0.30$ is satisfied, and still more preferably, a relationship of $W/((D1+D2)/2)=0.20$ is satisfied. In the following description, a direction along the straight line L connecting the centers O1 and O2 of the cross-sectional circles C1 and C2 of the adjacent two cylindrical spaces S1 and S2 is referred to simply as a width direction X.

By setting the degree of overlapping of the cylindrical spaces S1 and S2 as described above, it is possible to reliably cause a phenomenon in which separated swirling flows R1 and R2 are generated in the cylindrical spaces S1 and S2, respectively, and the swirling flows R1 and R2 flow into the opposite cylindrical spaces S2 and S1, respectively, as described later with reference to FIG. 6.

Figure 6:
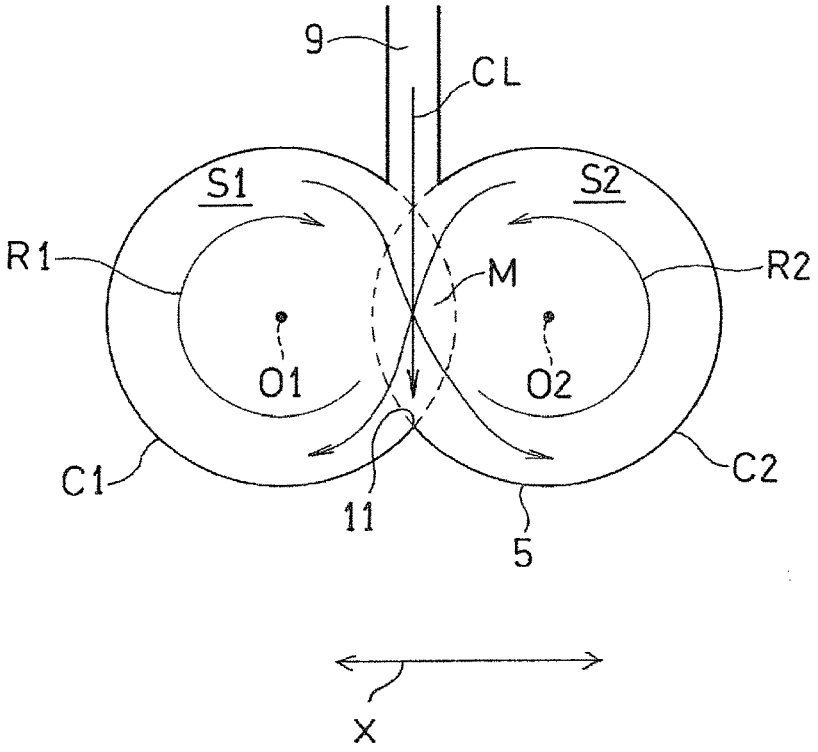
FIG. 6 is a cross-sectional view schematically showing a function of the cooling structure shown in FIG. 2.

As shown in FIG. 6, a cooling medium supply passage 9 that supplies the cooling medium CL to the first cooling medium passage 5 is connected to an overlapped region M of the adjacent two cylindrical spaces S1 and S2 of the first cooling medium passage 5. Specifically, the cooling medium supply passage 9 may be connected to the overlapped region M such that the cooling medium CL supplied from the cooling medium supply passage 9 to the first cooling medium passage 5 collides against a partition edge 11 formed between the adjacent two cylindrical spaces S1 and S2. More specifically, the cooling medium supply passage 9 may be connected to the overlapped region M between the cylindrical spaces S1 and S2 so as to be orthogonal to the width direction X in the cross-sectional view, and so that the center of the passage substantially coincides with the facing partition edge 11. In this specification, as shown in FIG. 3, the partition edge 11 is defined as an edge, extending in the longitudinal direction of the first cooling medium passage 5, formed between the adjacent cylindrical spaces S1 and S2, that is, formed at a portion partitioning a peripheral wall forming the cylindrical space S1 and a peripheral wall forming the cylindrical space S2.

Figure 5:
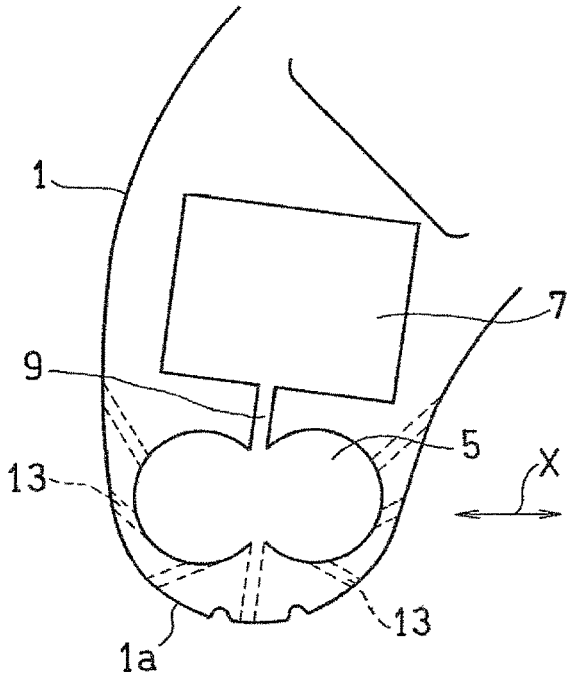
FIG. 5 is a transverse cross-sectional view showing a front end portion of the turbine blade shown in FIG. 2.

As shown in FIG. 5, the width direction X substantially coincides with the thickness direction of the turbine rotor blade 1, for example. The cooling medium CL supplied into the first cooling medium passage 5 is jetted from a plurality of jet holes 13 formed in the front end portion 1*a*, and cools the blade surface of the front end portion 1*a* in a film cooling manner.

Figure 7:
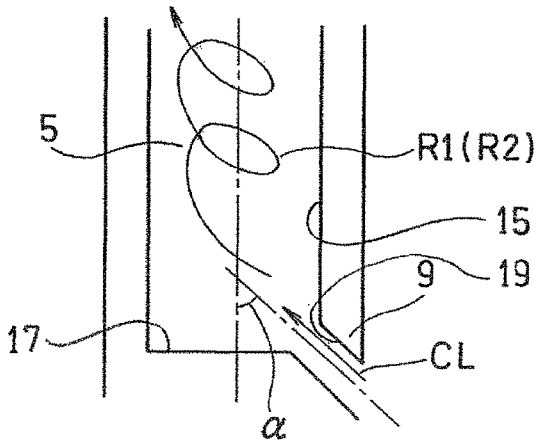
FIG. 7 is a cross-sectional view schematically showing a cooling medium supply passage of the cooling structure shown in FIG. 2.

Further, as shown in FIG. 7, the cooling medium supply passage 9 is connected to a portion of the first cooling medium passage 5 that includes a peripheral wall 15, in a direction forming an acute angle with respect to the longitudinal direction of the first cooling medium passage 5. In the example of FIG. 7, the cooling medium supply passage 9 is connected to a corner portion 19 formed between the peripheral wall 15 at an upstream side end portion of the first cooling medium passage 5 and a bottom wall 17. An angle $\alpha$ formed between the longitudinal direction of the cooling medium supply passage 9 and the first cooling medium passage 5 is not particularly limited as long as its value is greater than 0° and smaller than 90°. However, in order to cause the cooling medium CL to reliably form the swirling flows in the first cooling medium passage 5, this angle $\alpha$ may be within a range of $15° \leq \alpha \leq 60°$, and more preferably, within a range of $30° \leq \alpha \leq 45°$.

According to the cooling structure including the first cooling medium passage 5 configured as described above, as shown in FIG. 6, the cooling medium CL supplied from the portion including the peripheral wall of the first cooling medium passage flows through the cooling medium supply passage 9 separately into the cylindrical spaces S1 and S2 of the first cooling medium passage 5, and thereafter, forms the swirling flows R1 and R2 in the cylindrical spaces S1 and S2, respectively. Further, when the cooling medium CL passes in the first cooling medium passage 5 as the swirling flows R1 and R2, a portion of the cooling medium CL on the outer diameter side of the swirling flow R1 flows from the cylindrical space S1 into the cylindrical space S2 through the overlapped region M of the spaces S1 and S2, and a portion of the cooling medium CL on the outer diameter side of the swirling flow R2 flows from the cylindrical space S2 into the cylindrical space S1 through the overlapped region M. In this way, while the swirling flows R1 and R2 in the cylindrical spaces S1 and S2 flow into the opposite cylindrical spaces S2 and S1, respectively, mixing of the cooling medium CL is promoted, and thus temperature distribution in the cooling medium CL is made uniform, resulting in high cooling efficiency. Furthermore, since the swirling flows R1 and R2 collide against the partition edge 11 formed between the cylindrical spaces S1 and S2, high cooling effect due to impingement effect is achieved.

Particularly in the illustrated example, since the cooling medium supply passage 9 is connected to the overlapped region M of the adjacent cylindrical spaces S1 and S2, the cooling medium CL collides against the partition edge 11 formed between the spaces S1 and S2 also when the cooling medium CL flows from the cooling medium supply passage 9 into the first cooling medium passage 5. Due to the partition edge 11, the cooling medium CL is substantially uniformly distributed to the cylindrical spaces S1 and S2, and thus the swirling flows R1 and R2 that swirl in opposite directions along the inner wall surfaces forming the cylindrical spaces S1 and S2. As a result, mixing of the cooling medium CL in the overlapped region M is further promoted. Furthermore, also in the portion that supplies the cooling medium CL, the cooling medium CL is caused to collide against the partition edge 11, whereby cooling of the wall surface is promoted due to the impingement effect. These effects result in extremely high cooling efficiency.

The mode of the cooling structure is not limited to the above-mentioned example. As long as a cooling medium passage provided in a turbine blade has a shape in which a plurality of substantially cylindrical spaces extending in parallel with each other partially overlap each other and a cooling medium supply passage is connected to a portion of the cooling medium passage that includes a peripheral wall, in a direction forming an acute angle with respect to the longitudinal direction of the cooling medium passage, mixing of the cooling medium CL is promoted when swirling flows in the respective cylindrical spaces flow into the opposite cylindrical spaces, resulting in an effect that temperature distribution in the cooling medium CL is made uniform.

Figure 8A:
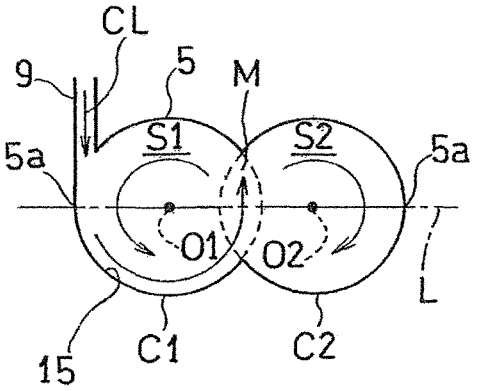
FIG. 8A is a cross-sectional view schematically showing an example of a cooling structure of a turbine blade according to a second embodiment of the present invention.
Figure 8B:
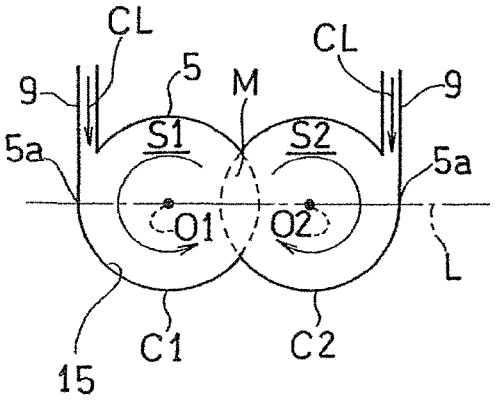
FIG. 8B is a cross-sectional view schematically showing an example of a cooling structure of a turbine blade according to a second embodiment of the present invention.

For example, as a second embodiment of the present invention, as shown in FIG. 8A, the cooling medium supply passage 9 may be connected to one of side portions 5*a* and 5*a* of the first cooling medium passage 5, on the straight line L, on a side opposite to the overlapped region M of the cylindrical spaces. Alternatively, as shown in FIG. 8B, two cooling medium supply passages 9 may be provided and connected to respective side portions of the first cooling medium passage 5. When the cooling medium supply passage(s) 9 is connected to the side portion(s) 5*a* of the cooling medium passage 5 as described above, the direction in which the cooling medium CL is supplied from the cooling medium supply passage 9 may be set to be a tangential direction of the cross-sectional circles C1 and C2 in the cross-sectional view of the first cooling medium passage 5. The configuration of the second embodiment other than that particularly described above is identical to that of the first embodiment, including the configuration in which the cooling medium supply passage 9 is connected to the portion including the peripheral wall 15 of the first cooling medium passage 5, in the direction forming an acute angle with respect to the longitudinal direction of the first cooling medium passage 5.

Figure 9A:
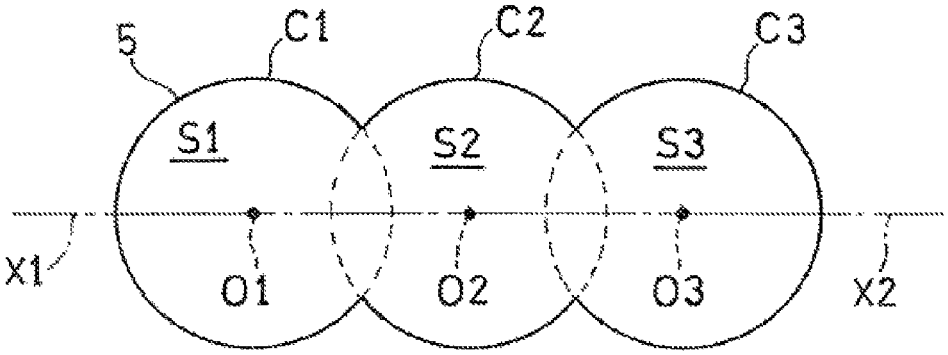
FIG. 9A is a cross-sectional view schematically showing an example of a cooling structure of a turbine blade according to a third embodiment of the present invention.
Figure 9B:
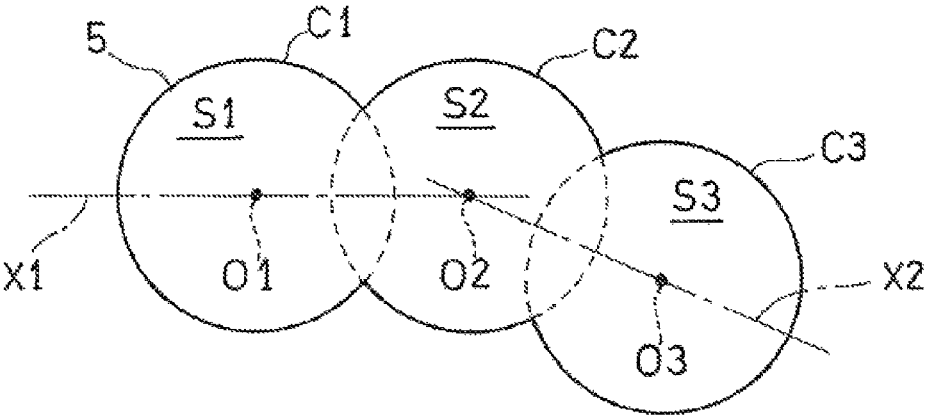
FIG. 9B is a cross-sectional view schematically showing an example of a cooling structure of a turbine blade according to a third embodiment of the present invention.

The number of cylindrical spaces forming the first cooling medium passage 5 is not limited to two. As a third embodiment of the present invention, as shown in FIGS. 9A and 9B, for example, three cylindrical spaces S1, S2, and S3 may be arrange in order so that the adjacent cylindrical spaces S1 and S2 overlap each other and the adjacent cylindrical spaces S2 and S3 overlap each other. In this case, as shown in FIG. 9A, the first cooling medium passage 5 may have a shape in which the three cylindrical spaces S1 to S3 are arranged in a substantially straight line (that is, centers O1, O2, and O3 of cross-sectional circles C1, C2, and C3 are in the same straight line). Alternatively, in accordance with the shape of a portion of a turbine blade to which the cooling structure is applied, as shown in FIG. 9B, the first cooling medium passage 5 may have a shape in which a width direction X1 of the cylindrical spaces S1 and S2 and a width direction X2 of the cylindrical spaces S2 and S3 are not parallel with each other (that is, the centers O1, O2, and O3 of the cross-sectional circles C1, C2, and C3 are not on the same straight line). The same applies to the case where the number of the cylindrical spaces is four or more.

The configuration of the third embodiment other than that particularly described above is identical to that of the first embodiment, including the configuration in which the cooling medium supply passage 9 is connected to the portion including the peripheral wall 15 of the first cooling medium passage 5, in the direction forming an acute angle with respect to the longitudinal direction of the first cooling medium passage 5.

The cooling structures according to the first to third embodiments are each applied to the front end portion 1*a* of the turbine rotor blade 1. However, instead of or in addition to the front end portion 1*a*, each cooling structure may be applied to the second cooling medium passage 7 for cooling the rear part 1*b*. In any embodiment, the cooling medium CL is not limited to compressed air from a compressor, and other gases or liquids generally used as cooling mediums may be adopted. Furthermore, the cooling structure according to the present invention may also be applied to a turbine stator blade as a turbine blade of a gas turbine, in addition to the turbine rotor blade 1.

Although the present invention has been described above in connection with the embodiments thereof with reference to the accompanying drawings, numerous additions, changes, or deletions can be made without departing from the gist of the present invention. Accordingly, such additions, changes, or deletions are to be construed as included in the scope of the present invention.

REFERENCE NUMERALS

1 . . . Turbine rotor blade (turbine blade)
5 . . . First cooling medium passage (Cooling medium passage)
9 . . . Cooling medium supply passage
15 . . . Peripheral wall of cooling medium passage
CL . . . Cooling medium
C1, C2, C3 . . . Cross-sectional circle
M . . . Overlapped region
O1, O2, O3 . . . Center of cross-sectional circle
S1, S2, S3 . . . Cylindrical space

What is claimed is:

1. A turbine blade cooling structure for internally cooling a turbine blade, comprising:

a cooling medium passage provided in the turbine blade and having a shape in which a plurality of cylindrical spaces, each having a substantially cylindrical shape, extending in parallel with each other partially overlap each other; and a cooling medium supply passage to supply a cooling medium to the cooling medium passage connected to a portion of the cooling medium passage that includes a peripheral wall, said cooling medium passage forms an acute angle with respect to a longitudinal direction of the cooling medium passage.

2. The turbine blade cooling structure as claimed in claim 1, wherein the two cylindrical spaces adjacent to each other overlap each other such that an overlap length W along a straight line connecting centers of cross-sectional circles of the adjacent two cylindrical spaces satisfies a relationship of $0.05 \leq W/((D1+D2)/2) \leq 0.35$ with respect to a cross-sectional diameter D1 of one of the cylindrical spaces and a cross-sectional diameter D2 of the other cylindrical space.

3. The turbine blade cooling structure as claimed in claim 1, wherein the cooling medium supply passage is connected to an overlapped region of the adjacent two cylindrical spaces of the cooling medium passage.

4. The turbine blade cooling structure as claimed in claim 3, wherein the cooling medium supply passage is connected to the overlapped region such that the cooling medium supplied from the cooling medium supply passage collides against a partition edge formed between the adjacent two cylindrical spaces.

5. The turbine blade cooling structure as claimed in claim 1, wherein the cooling medium supply passage is connected to a side portion of the cooling medium passage, the side portion being located at a side opposite to the overlapped region of the cylindrical spaces, on a straight line connecting centers of cross-sectional circles of the adjacent two cylindrical spaces of the cooling medium passage.

* * * * *